US006883273B2

(12) United States Patent
Kerkvliet

(10) Patent No.: US 6,883,273 B2
(45) Date of Patent: Apr. 26, 2005

(54) HYDRAULICALLY OPERATED OVERHEAD DOOR

(75) Inventor: Douglas J. Kerkvliet, Cottonwood, MN (US)

(73) Assignee: Cottonwood Welding & Manufacturing, Inc., Cottonwood, MN (US)

( * ) Notice: Subject to any disclaimer, the term of this patent is extended or adjusted under 35 U.S.C. 154(b) by 98 days.

(21) Appl. No.: 09/873,481

(22) Filed: Jun. 4, 2001

(65) Prior Publication Data

US 2002/0029524 A1 Mar. 14, 2002

Related U.S. Application Data

(63) Continuation of application No. 09/432,309, filed on Nov. 2, 1999, now abandoned.
(60) Provisional application No. 60/107,826, filed on Nov. 10, 1998.

(51) Int. Cl.[7] ..... E05F 11/00
(52) U.S. Cl. ..... 49/199; 49/203
(58) Field of Search ..... 49/197, 199, 200, 49/203, 204

(56) References Cited

U.S. PATENT DOCUMENTS

| | | | | |
|---|---|---|---|---|
| 3,464,161 A | | 9/1969 | Jonsson | 49/197 |
| 3,468,060 A | | 9/1969 | Mursinna | 49/200 |
| 4,294,055 A | | 10/1981 | Andresen | 52/795 |
| 4,378,043 A | * | 3/1983 | Sorenson | 160/97 |
| 4,397,115 A | | 8/1983 | Crawford | 49/70 |
| 4,525,953 A | | 7/1985 | Stutzman | 49/488 |
| 4,643,239 A | | 2/1987 | Wentzel | 160/201 |
| 5,588,270 A | * | 12/1996 | Keating | 52/291 |
| 5,749,407 A | * | 5/1998 | Brenner et al. | 160/229.1 |
| 5,784,834 A | | 7/1998 | Stutzman | 49/475.1 |

FOREIGN PATENT DOCUMENTS

| | | | |
|---|---|---|---|
| BE | 519853 | 5/1930 | 49/203 |
| DE | 1584043 | 3/1969 | 49/200 |

* cited by examiner

*Primary Examiner*—Jerry Redman
(74) *Attorney, Agent, or Firm*—Westman, Champlin & Kelly, P.A.

(57) ABSTRACT

An overhead door assembly in which the door assembly has a vertical closed position and a horizontal opened position, the door assembly including a frame having a horizontal support member and first and second vertical members fixedly mounted to either end of the horizontal member, the vertical members are fixedly mounted to the ground. A one piece door member includes top and bottom horizontal ends and first and second vertical sides and is pivotally mounted to the horizontal member of the frame with the door member being movable from a closed position to an opened position about a pivot point. A hydraulic cylinder is pivotally mounted on a portion of either of the first or second vertical members and the second end of the hydraulic cylinder is pivotally mounted to the door member. The hydraulic cylinder includes a ram movably disposed within the cylinder and transmits an opening and closing force to the door member.

26 Claims, 15 Drawing Sheets

HYDRAULICALLY OPERATED OVERHEAD DOOR

CROSS-REFERENCE TO RELATED APPLICATION(S)

This application is a continuation of application Ser. No. 09/432,309, filed Nov. 2, 1999, entitled "Hydraulicaly Operated Overhead Door now abandoned.

BACKGROUND OF THE INVENTION

The present invention relates to overhead doors for use in buildings, especially for buildings with large openings.

Agricultural, aviation, commercial buildings and the like generally require a large opening for accommodating trucks, tractors, airplanes, large farm equipment (e.g. combines), large industrial equipment, and others, through such opening. Common types of conventional door assemblies currently used to accommodate this need include two piece center hinging cable drawn doors (bi-fold) and horizontally sliding doors that are supported by and slide on a track system. These types of conventional doors generally require a larger opening than is required to accommodate the door members, thus reducing the overall available vertical height of the building opening that can be provided for a given limited area of space or land. Furthermore, these types of doors require that the building be engineered with extra reinforcement because the load of the door is generally supported by the building itself.

The most common types of door assemblies used in buildings are the two piece center hinging cable drawn doors. Cables draw the bottom end of the door directly vertically towards the top of the door, while being guided on a track system. During the opening process, the hinged portion of the door moves in an outwardly and upwardly direction causing the bottom leaf of the door to fold underneath the top leaf. Consequently, this requires a larger building height to accommodate the desired opening. Furthermore, since the door itself is mounted to the building structure, the building bears the entire load of the door and must be reinforced accordingly. The bi-fold door also has other disadvantages because it is operated by a cable/pulley system having many moving parts, resulting in a high wear and high maintenance system. Furthermore, the bi-fold door must be locked down manually to effect a complete closure and has an inherently slow open/close cycle time, making the opening/closing process inconvenient and time consuming. Additionally, in the event of a failure of any of these mechanical components, the door may drop, thus creating a safety hazard. Moreover, the bi-fold door is drafty because it closes against the exterior of the building and the joints are exposed to the elements.

Other conventional types of door assemblies include horizontally sliding doors. These types of doors are supported by and slide on a track system. Problems also arise with these doors since the track can accumulate ice, mud and other debris that can push the door out of alignment with the track, making it difficult to operate. Once the doors are out of alignment, they are generally difficult to open and close. Moreover, horizontally sliding doors require storage space on either side of the building opening to accommodate the door leaves when the door is in the open position. The storage space required to accommodate the door leaves reduces the usable width of the building opening that can be provided for a given limited area of space or land.

Accordingly, for the foregoing reasons, there is a need for a door that pivots on a load bearing frame that is separate from the building structure such that the door does not hang on and load the building structure. There is also a need for a door that includes its own separate framework, such that loads placed on means for operating the door are transferred to the load bearing frame and not to the building structure.

There is also a need for a door that maximizes the useable space of the available opening in the building. For example, there is a need for a door that utilizes virtually no overhead or side door storage space making it possible to provide a smaller building size for a given required building opening size, or maximize an existing opening available in a building.

Furthermore, there is a need for a door member that has no moving parts such as pulleys, shafts, bearings, gear boxes, track systems or the like, thus making the door member virtually maintenance free. Also, there is a need for a door that includes means for connecting alternative power sources for operating the door in the event of an electrical power outage. There is also a need for a door that closes flush with the exterior building wall to provide a weather tight seal.

BRIEF SUMMARY OF THE INVENTION

To overcome the limitations of the related art described above, and to overcome other limitations that will become apparent upon reading and understanding the present specification, the invention is directed to an apparatus for an outwardly opening hydraulically actuated door assembly for a building having an opening to be closed by the door assembly.

The apparatus having features of the invention is a door assembly that hangs on its own framework that is separate from the building structure. The door assembly having features of the invention can be custom built to fit virtually any building, new or existing. The building structure does not have to be taller than the door to accommodate the door. The door assembly having features of the invention can be horizontal support member and first and second vertical members fixedly mounted to either end of the horizontal member, the vertical members being fixedly mounted to the ground. The assembly also includes a one-piece door member having a thickness including top and bottom horizontal ends and first and second vertical sides, the top horizontal end of the door member being pivotally mounted to the horizontal member of the frame, the door member being movable from a closed position to an open position about the pivot point. The assembly also includes a hydraulic cylinder having a first and second end, the first end pivotally mounted on a portion of either one of the first and second vertical member, and the second end pivotally mounted to the door member.

A further aspect of the invention includes a frame for an overhead door. The frame includes a horizontal support member; first and second vertical members fixedly mounted to either end of the horizontal member, and ground anchoring means disposed on the first and second vertical members, anchoring the frame to the ground.

Still another aspect of the invention includes an overhead door having a vertical closed position and a horizontal open position provided in a building having an opening to be closed by the door. The overhead door provided in the building includes a one-piece door member having a thickness including top and bottom horizontal ends and first and second vertical sides. The overhead door provided in the building also includes means for fixedly mounting the top horizontal end of the door member to a support structure;

means for mounting to the door member a mechanism adapted and configured to open and close the door member; means for supporting the bottom horizontal end of the door member; and means for sealing the bottom horizontal end of the door member against the ground.

Yet another aspect of the invention includes a frame for an overhead door provided in a building having an opening to be closed the door. The frame provided in the building includes a horizontal support member; first and second vertical members fixedly mounted to either end of the horizontal member; and ground anchoring means disposed on the first and second vertical members, anchoring the frame to the ground.

These and various other features of novelty as well as advantages which characterize the invention are pointed out with particularity in the claims annexed hereto and form a part hereof. However, for a better understanding of the invention reference should be made to the drawings which form a further part hereof, and to accompanying descriptive matter, in which there are illustrated and described specific examples of an apparatus in accordance with the invention.

BRIEF DESCRIPTION OF THE DRAWINGS

Referring now to the drawings in which like reference numbers represent corresponding parts throughout, where.

DETAILED DESCRIPTION

In the following description of the specific embodiments, reference is made to the accompanying drawings which form a part hereof, and in which is shown by way of illustration the specific embodiments in which the invention may be practiced. It is to be understood that other embodiments may be utilized as structural changes may be made without departing from the scope of the present invention.

Figure 1:
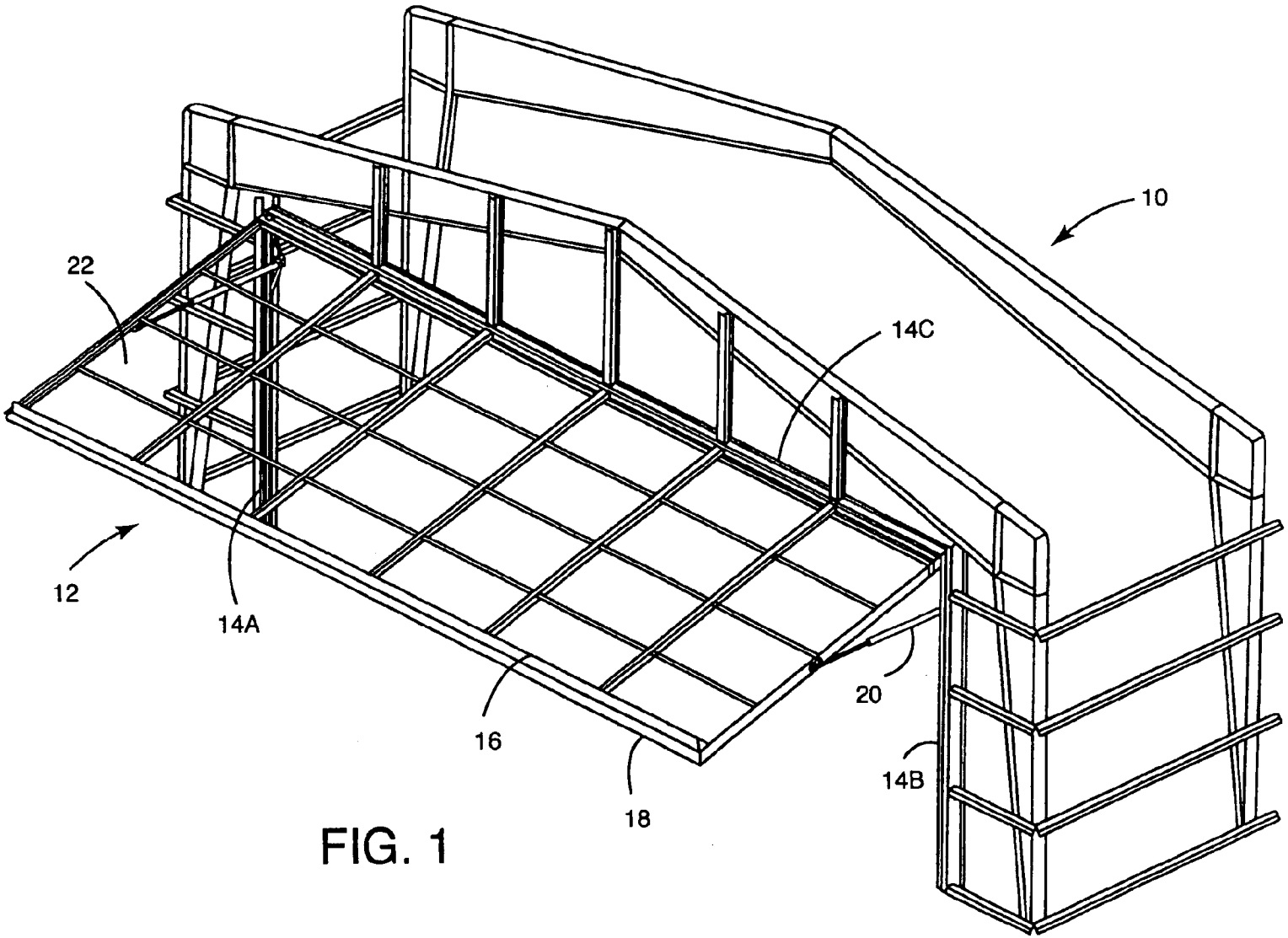
FIG. 1 is a view of a door assembly provided in a building.
Figure 2:
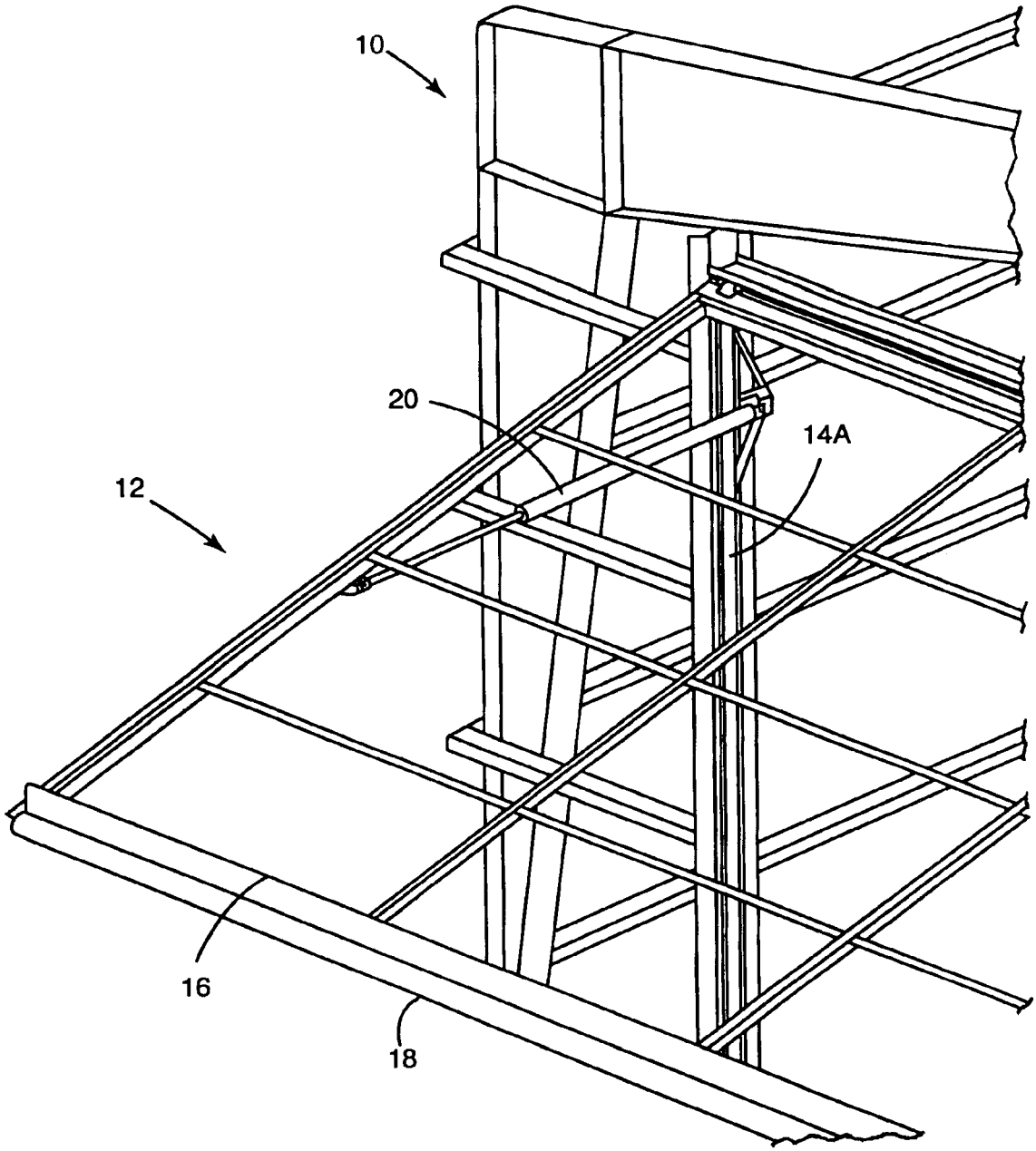
FIG. 2 is a detail view of a door assembly provided in a building.

FIGS. 1 and 2 illustrate generally a building 10 provided with a door assembly 12 in a partially open position. The door assembly includes a frame 14. The frame comprises two vertical support members 14A, B (e.g. steel tube jambs) and a horizontal support member 14C (e.g. a steel tube header). The assembly also includes a door member 22 (supporting grid structure only is shown). The door member 22 includes a support truss 16 and a weather tight resilient seal 18 disposed along the bottom horizontal end of the door member 22. The door assembly 12 also includes a hydraulic cylinder 20 for opening and closing the door member 22.

Door Frame

Figure 3:
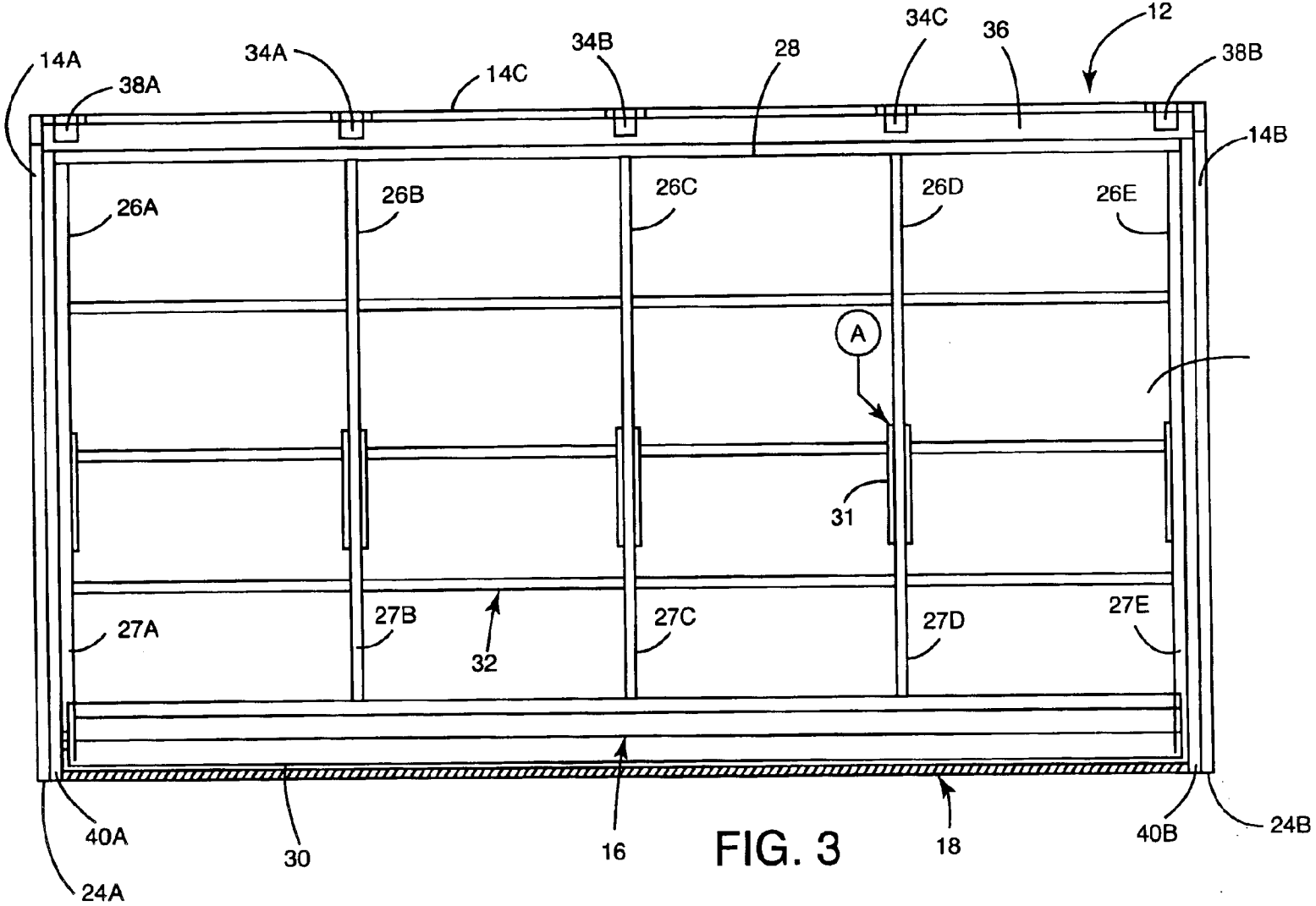
FIG. 3 is a front elevation view of a door assembly.

FIG. 3 illustrates the door assembly 12 including the support frame 14, the supporting grid structure of the door member 22, the truss support system 16, the door member seal 18 and the hinges 34, 38 providing the pivot point for opening and closing the door member 22.

The door assembly 12 mounts to a given building structure via the provided supporting frame 14 from which the actual door member 22 is hung. The frame 14 includes the horizontal steel tube header 14C, and the vertical steel tube jambs 14A, B that connect to the floor or the ground. Both vertical jambs 14A, B are secured to the given building structure 10 using fastening means (not shown) that are generally known by those skilled in the art such as screws, rivets, adhesives, and the like. Steel plates 24A, B are secured to the bottom of each vertical jamb 14A, B connecting to the floor. The steel plates 24A, B are anchored to a concrete pad or footing or to other means provided.

The door member 22 includes load bearing supporting uprights 26 and Z-girt members 32 for attaching tin or other "skinning" materials for covering the door member's 22 supporting frame structure. Generally, the door member 22 is covered or "skinned" with the sane material as the rest of the building. The door member 22 also includes an upper structural member 28 and a lower structural member 30. Together the supporting members 26, 28, 30, 32 provide the basic framework of the door member 22.

The door assembly 12 includes outer hinges 38 and inner hinges 34 for mounting and supporting the door member 22 on the frame 14. The hinges 34, 38 also provide a pivoting point for the door member 22 while opening or closing the building opening. The door assembly 12 also includes a hinged angled member 36 (e.g. an angle iron) and side angled members 40 (e.g. angle irons). The angled members 36, 40 have a compressed foam seal disposed thereon. The foam provides a weather tight seal on three sides of the door member. The door member 22 also includes a door splice member 31 for splicing the upper vertical support members 26 with the lower vertical support members 27.

Figure 4:
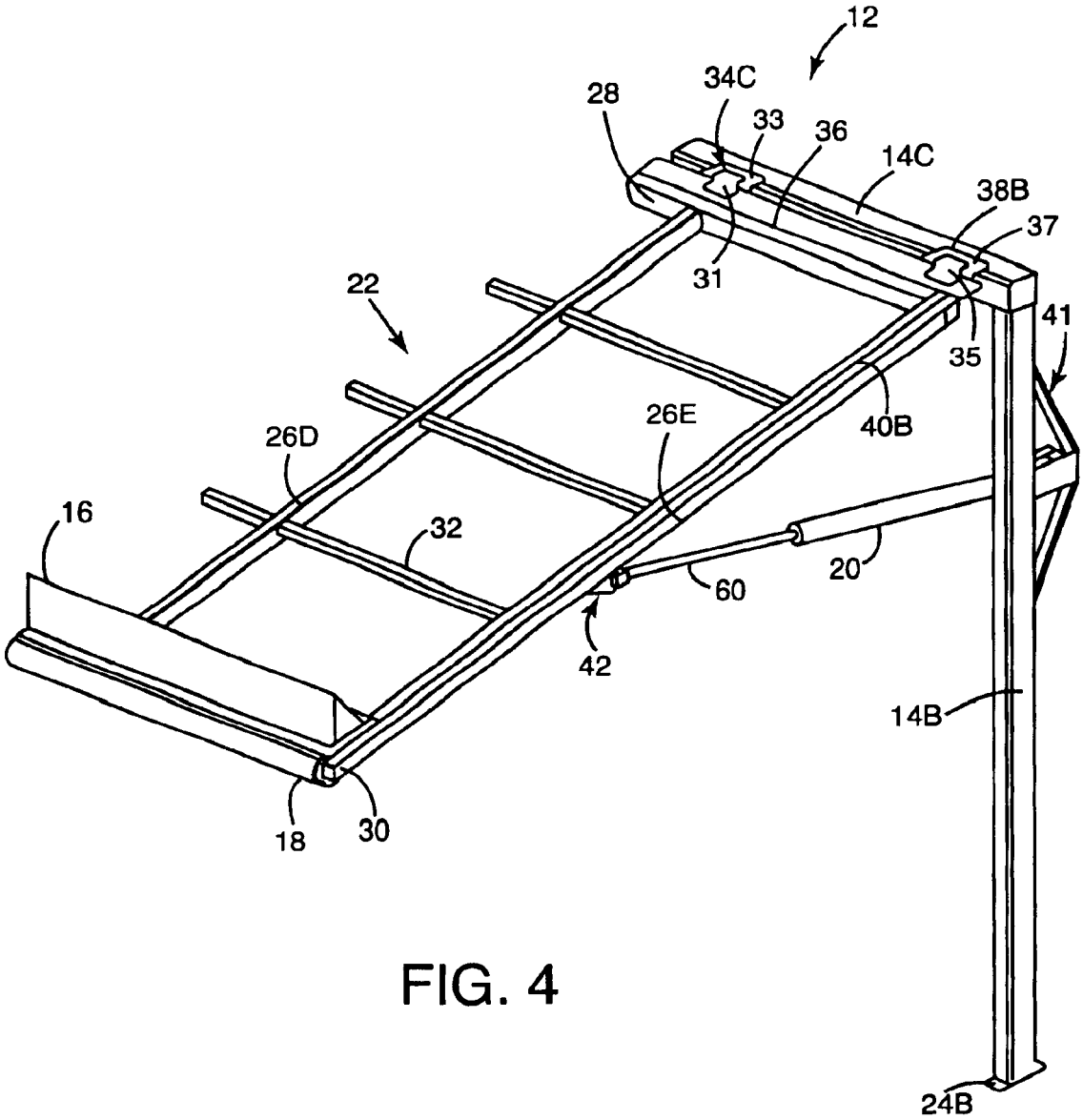
FIG. 4 is a front isometric view of a door assembly with the door in a partially open position.

FIG. 4 illustrates the door member 22, the truss support system 16, the door member sealing means 18 and the hinging means 34, 38 in accordance with one embodiment of the present invention, as follows:

Door Member

The door member 22 is constructed of steel tubing and includes four basic components. The lower pinpoint assembly 42 and the outer hinge 38B are attached to the load bearing upright 26E which is located vertically at the outermost portion of the door member 22. The center hinge 34C is attached to the center support upright 26D which, is located in a vertical position between the load bearing upright tubes 26A, B at a spacing not exceeding eight feet. The upper structural tube 28 is placed and secured horizontally across the top of all the uprights 26. The lower structural tube 30 is placed and secured horizontally across the bottom of all the uprights 26 or 27, depending on the configuration of the door member 22.

Truss Support System

The door member 22 is constructed with a load bearing arc such that the door member 22 does not lose its structural integrity whenever it is placed in an outwardly, horizontal open position. Pressure is applied on the lower structural tube 30 creating the arc. A "V-truss" 16 is disposed horizontally along the bottom horizontal end of the door member 22 and is fastened onto the lower outside face of the door member 22 with the point of the "V" facing directly outwardly, thus maintaining the load bearing arc.

Door Member Seal

The seal 18 is disposed horizontally along the bottom portion of the door member 22. The seal 18 is a rubber strap secured to the inside and the outside face of the lower structural tube 30. The seal 18 wraps underneath the door member 22 when the door member 22 is in a closed position, thus creating a weather tight seal capable of conforming to irregularities of the floor surface.

The top seal and side seals are constructed of angled members 36, 40 and a compressed foam stripping. The vertical angled member 40B is secured vertically to the door member 22 and closes flush with the outside face of the load bearing uprights 26A, B. The horizontal angled member 36 is secured horizontally to the door member 22 and closes flush with the outside face of the upper structural tube 28. When the door member 22 is in a close position the angled member 40B overlaps the inside corner of the outside face of the jamb 14B. Likewise, the angled member 36 overlaps the outside face of the horizontal header 14C. The compressed foam stripping is disposed along the entire length of the inside portion of the angled members 36, 40 and overlaps the outside face of the door frame 14. Insulation up to five-inches thick may be added to the interior portion of the door member 22, thus providing an insulating R-value between 19–24.

The Hinges

The outer hinges 38 and the inner hinges 34 are secured above each vertical support upright 26. A first portion of the hinges 31,35 includes a steel plate with an end wrapped around to form an elongated hole therethrough. The steel plate is fastened to the horizontal angled member 36. A second portion of the hinges 33, 37, includes a steel plate with an end wrapped around to form an elongated hole therethrough, matching the size and placement of the first portion such that the first portion 31, 35 is accommodated within the second portion 33, 37. The second hinge portions 33, 37 are also fastened to the top horizontal header 14C. The door member 22 is fastened to the frame 14C when the holes in both the first and second portions 31, 35 and 33, 37, respectively, are aligned and a bolt is placed through the elongated holes formed by the first and second portions 31, 35 and 33, 37, respectively.

Cylinder Pivot

Figure 5:
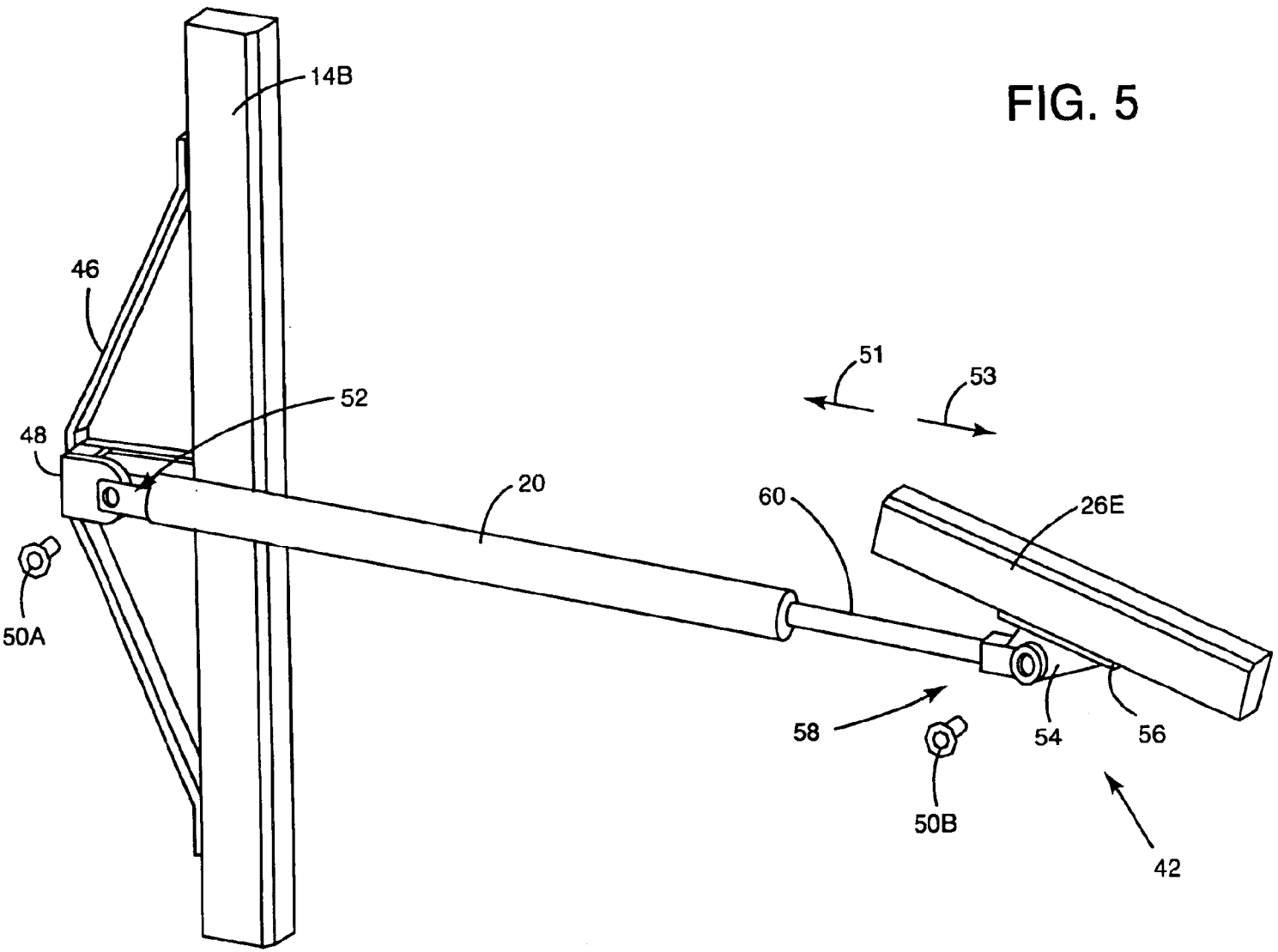
FIG. 5 is a view of upper and lower pinpoints of a hydraulic cylinder.

FIG. 5 illustrates the cylinder 20 pivotal means 42, 44 of the hydraulic power system in accordance with one embodiment of the present invention. An upper pinpoint assembly 44 constructed of one-inch thick steel plate includes two components, a J-shaped bracket 48 and a flat steel strap 46. The J-shaped bracket 48 is constructed of steel tubing and one-inch thick steel plate having a hole drilled therethrough. A top portion of the cylinder 52 is placed and pinned with a chrome shaft pin 50A to the J-shaped bracket 48. The J-shaped bracket 48 is perpendicularly placed and secured to the inside face of the jamb 14B facing directly inwardly in such a manner as to position the steel plate portion on the same plane as the steel plate 56 of the lower pinpoint assembly 42. The flat steel strap 46 is bent in such a manner as to be secured to the most inward portion of the J-shaped bracket 48 and the inside face of the jamb 14B, giving the upper pinpoint assembly 44 a three-point secured attachment.

The lower pinpoint assembly 42 is also constructed of a one-inch thick steel plate 56 and includes a teardrop shaped one-inch thick steel plate 54 with a hole drilled therethrough, in which the clevis end of the cylinder is secured with a chrome shaft pin 50B to the flat steel bar 56. The lower pinpoint assembly 42 is mounted and secured to the load bearing upright 26E of the door member 22 in such a manner as to allow the door to be closed tightly and securely against the door frame 14 as the cylinder ram 60 is retracted inwardly 51.

Hydraulic Powering System

Figure 6:
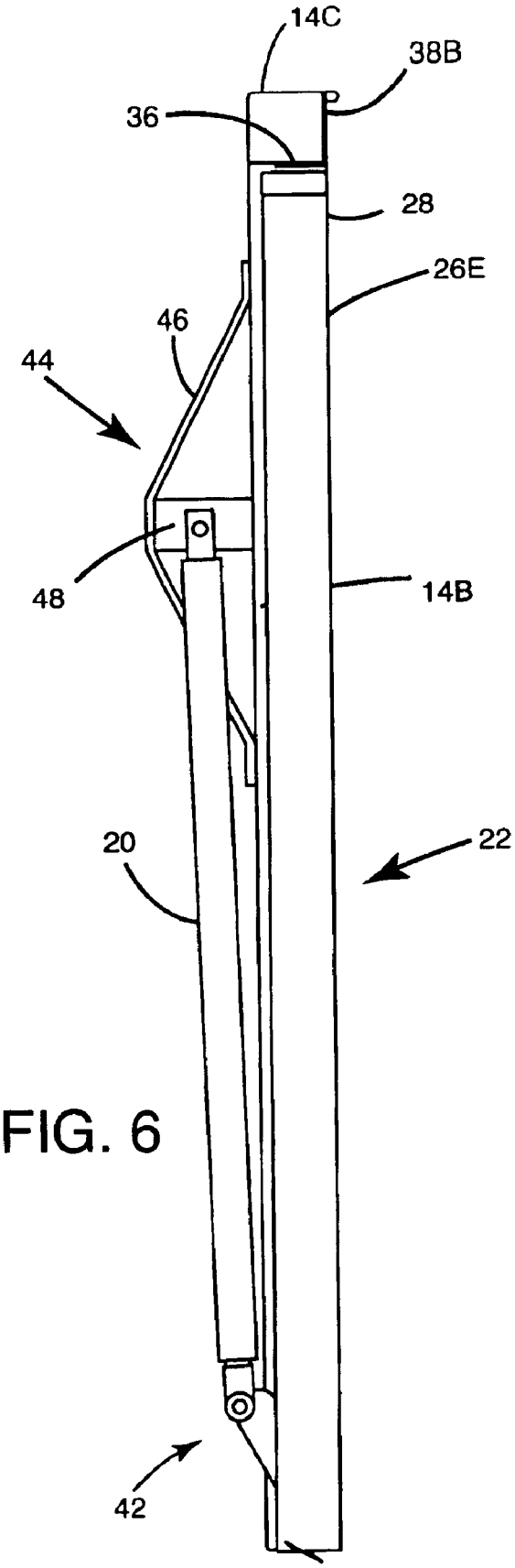
FIG. 6 is a view of upper and lower pinpoints of a hydraulic cylinder in a closed position.

FIG. 6 illustrates a cross sectional view of the door member 22 in a closed position. The hydraulic cylinder 20 is shown with the ram 60 in a fully retracted position.

Figure 7:
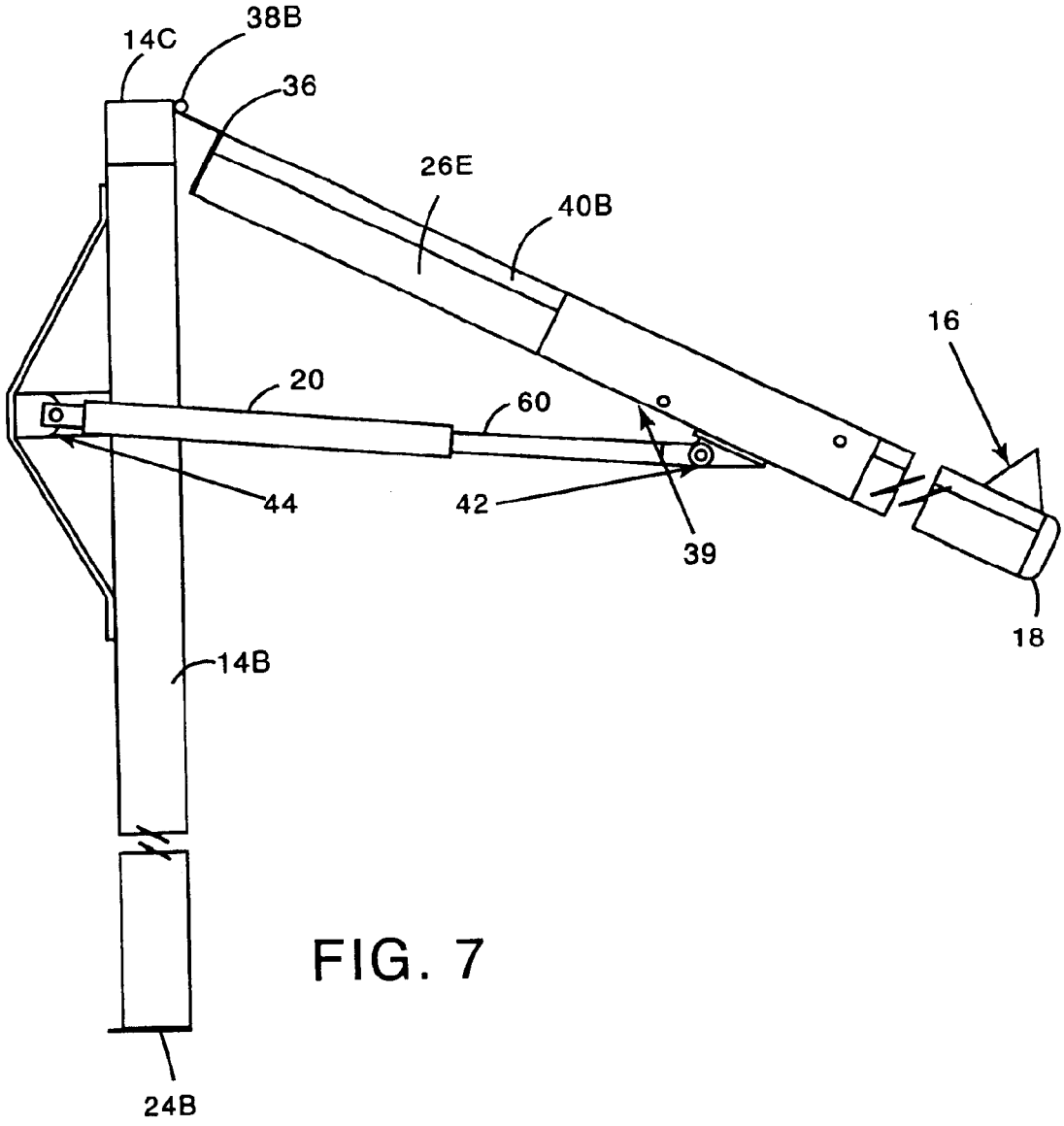
FIG. 7 is a side view elevation of a door assembly.

FIG. 7 is a side elevational view of the door member 22 in a partially open position. The steel plate 24B is secured to the bottom of the vertical jamb 14B for anchoring or connecting the jamb 14B to the floor, concrete pad or footing. The center splice 39 (shown in detail at FIG. 11) is used to splice the top vertical support members 26 to the bottom vertical support members 27.

Figure 8:
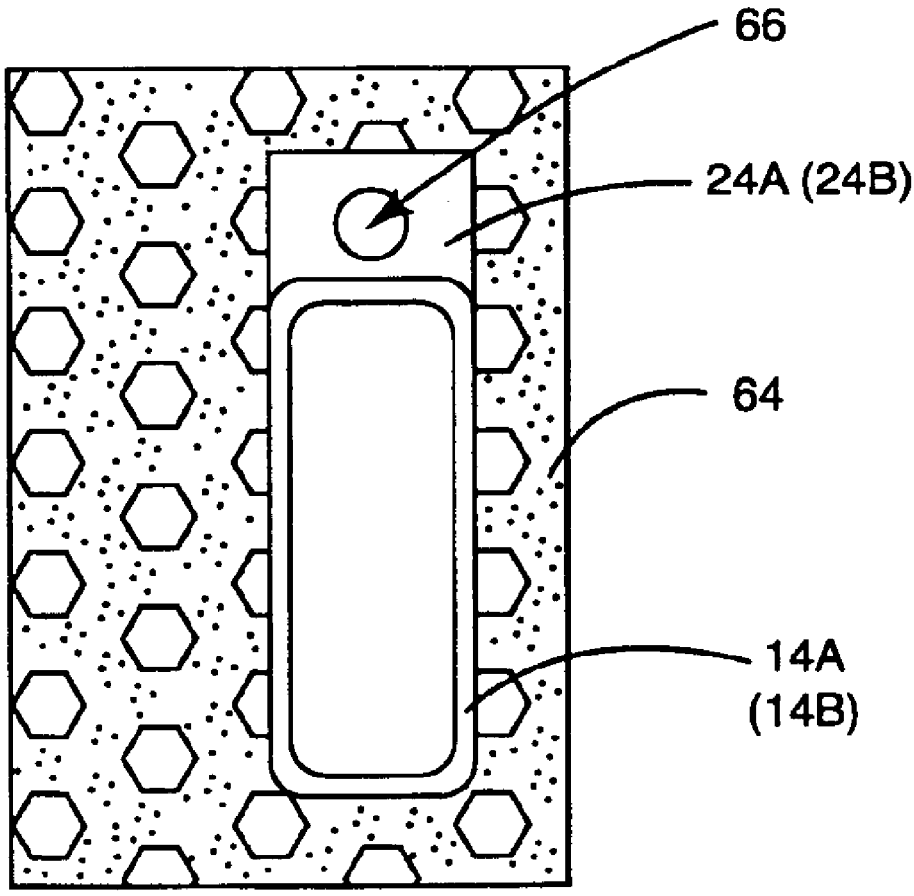
FIG. 8 us a top cut away view of a jamb connection to the floor.

FIG. 8 is top cut away view of the jamb 14A (14B) connection to the floor or concrete pad 64. The jamb 14A (14B) is secured or anchored to a concrete footing 64 with cement anchor bolts (not shown) disposed through hole 66 formed in the steel plate 24. The anchor bolt secures the steel plate 24 and the jambs 14A, 14B to provide a secure fastening of the frame 14 such that it is capable of supporting the load of the door member 22.

Figure 9A:
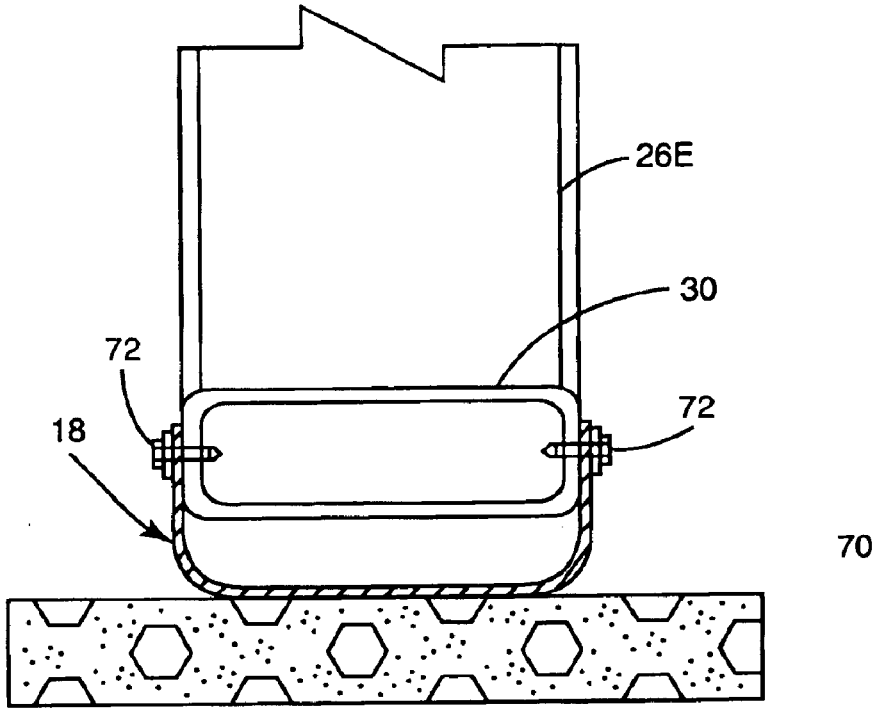
FIG. 9A is a side cut away view of a bottom seal.

FIG. 9A is a side cut away view of the bottom seal 18. The seal 18 is made of a resilient weather resistant material, and is fastened to the lower structural member 30 with sheet metal screws 72. Those skilled in art will appreciate that any number of fastening means may be utilized to fasten the seal 18 to the lower structural member without departing from the scope of the present invention. The seal 18 makes a weather tight seal between the door member 22 and the ground 70.

Figure 9B:
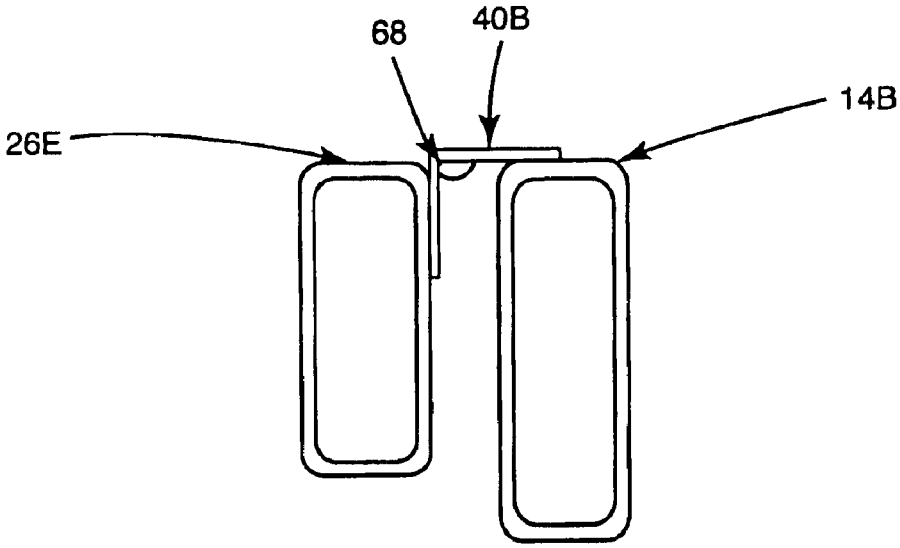
FIG. 9B is a top cut away view of a side seal.

FIG. 9B is a top cut away view of the side seal 68 sealing the two vertical sides on the top horizontal portion of the door member 22. The side seal 68 is formed of a compressed foam and is attached to the angled member 40B such that the foam 68 seals against the jamb 14B when the door member 22 is in a closed position. The foam seal 68 is fastened to the underside of the angled members 40A and 36 such that a seal is formed against the two vertical jambs 14 and the horizontal header 14C when the door member 22 is in a closed position. The angled members 40A, B are fastened to load bearing upright members 26A, E, respectively. Angled member 36 is fastened to the hinges 34, 38, such that the door member 22 is supported by the hinges 34, 38.

Figure 10B:
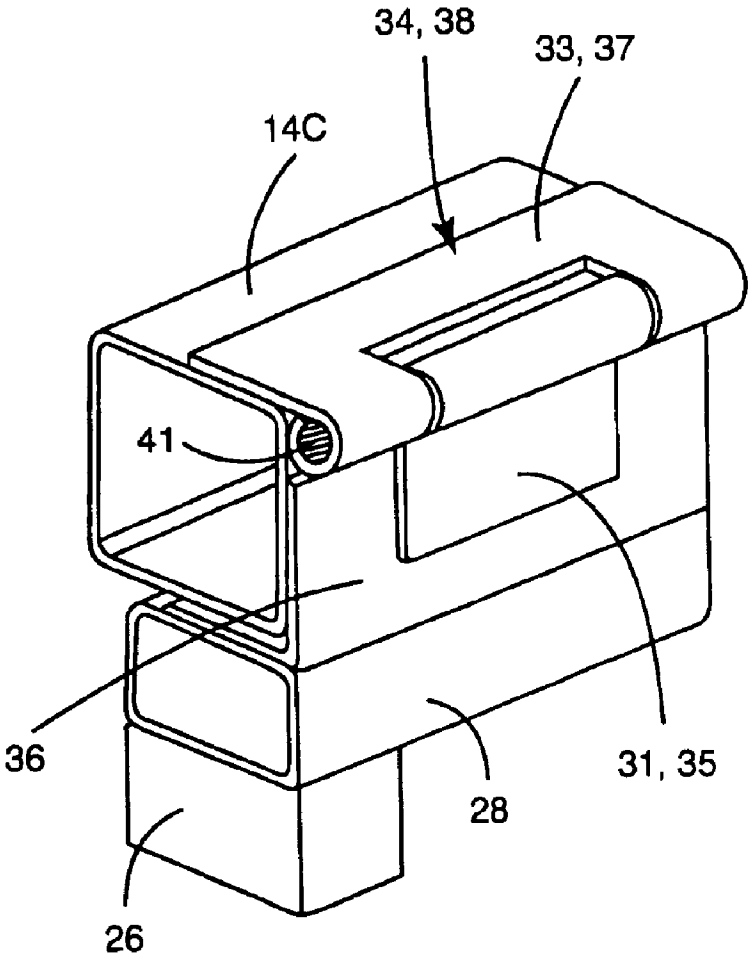
FIGS. 10A–10C are views of the top seal.
Figure 10A:
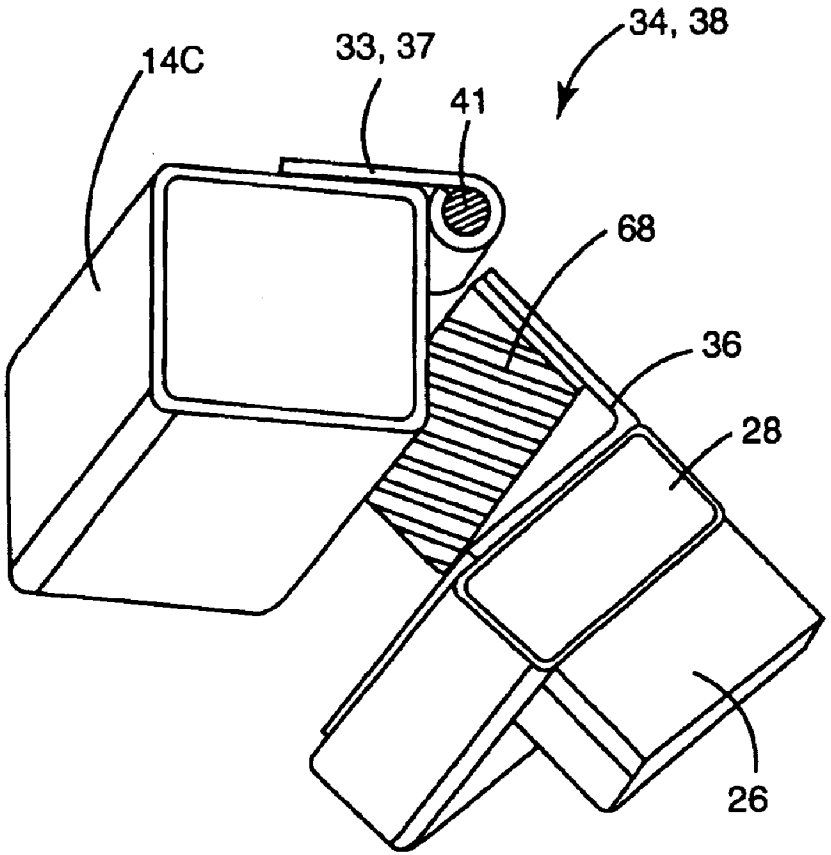
Figure 10C:
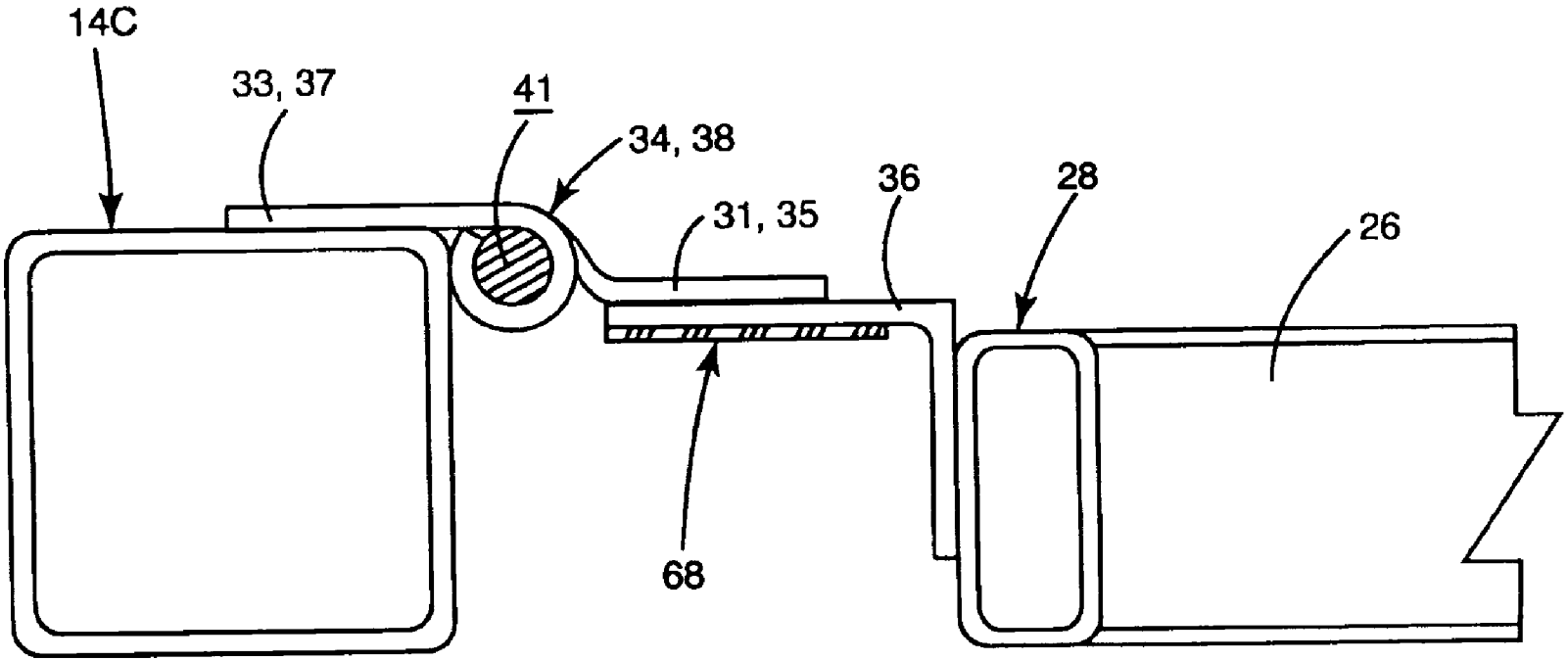

FIGS. 10A–C illustrate several views of the top horizontal header 14C fastened to the hinges 34, 38. Hinge portions 33 or 37 (depending on the specific configuration) are fastened to the top horizontal header 14C. Hinge portions 31 or 35 (depending on the specific configuration) are fastened to the top horizontally disposed angled member 36. The angled member 36 is fastened to the upper structural member 28. The upper structural member 28 is fastened to the vertical uprights 26. Hinge portions 33, 37 and 31, 35 are fastened by a bolt 41 inserted through axially defined holes of the binge portions of 33, 37 and 31, 35.

Figure 11:
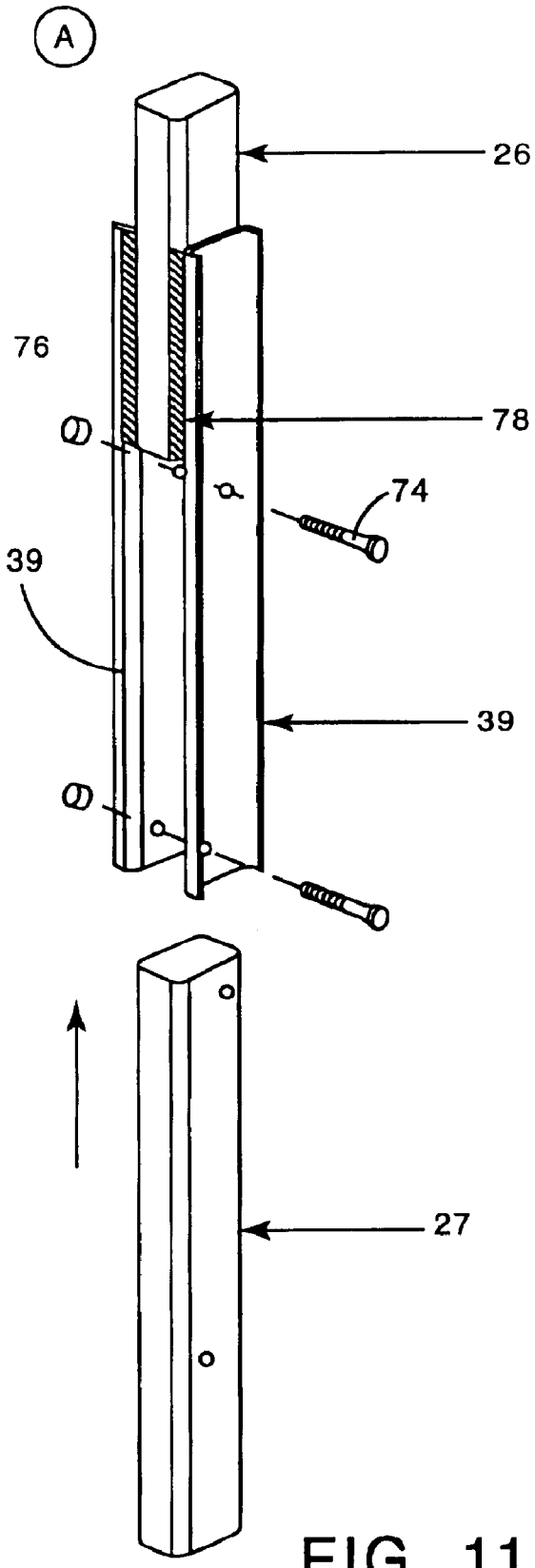
FIG. 11 is a view of a door splice.

FIG. 11 is a detailed view of the door splice. Lower vertical member 27 is spliced to the upper vertical member 26 with splice connection channels 39. The splice connection channels 39 are welded at 78 to the upper vertical members 26. The lower vertical members 27 are fastened to each splice connection channels 39 with bolts 74 and nuts 76.

Figure 12:
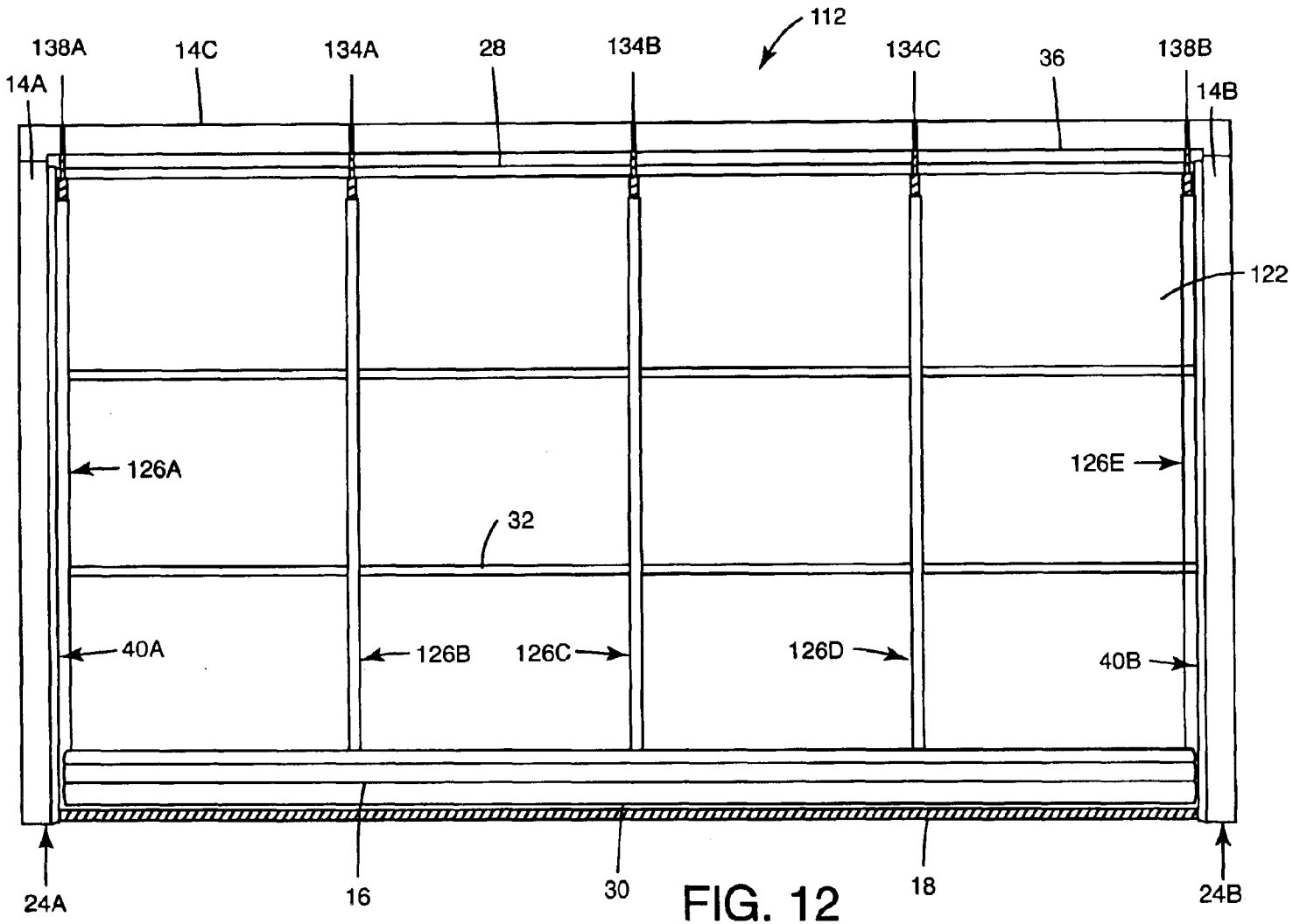
FIG. 12 is a front elevation view of a door assembly.

FIG. 12 illustrates an alternative embodiment of a door assembly 112 including the support frame 14, the supporting grid structure of the door member 122, the truss support system 16, the door member seal 18 and the hinges 134, 138 providing the pivot point for opening and closing the door member 122.

The door assembly 112 mounts to a given building structure via the provided supporting frame 14, from which the door member 122 is hung. The frame 14 consists of the horizontal steel tube header 14C, and the vertical steel tube jambs 14A, B that connect to the floor, the ground, a concrete pad or the like. Both vertical jambs 14A, B are secured to the given building structure 10 using fastening means (not shown) generally known by those skilled in the art such as screws, rivets, adhesives, and the like. Steel plates 24A, B are secured to the bottom of each vertical jamb 14A, B for anchoring the vertical jambs 14A, B to the floor, concrete pad or footing.

The door member 122 includes load bearing vertical supporting uprights 126 and Z-girt members 32 for attaching tin or other "skinning" materials for covering the door member's 122 supporting frame structure. The door member 122 also includes an upper structural member 28 and a lower structural member 30. Together the supporting members 26, 28, 30, 32 provide the basic framework for the door member 122.

The door assembly 112 includes outer binges 138 and inner hinges 134 for supporting the door member on the frame 14. The hinges 134, 134 also provide means for the door member 122 to pivot while opening or closing the building opening. The door assembly 112 also includes a hinging horizontal angled member 36 having a compressed foam stripping seal fastened to an underside thereto and side vertical angled members 40 also having a compressed foam stripping seal fastened to an underside thereto.

Figure 13:
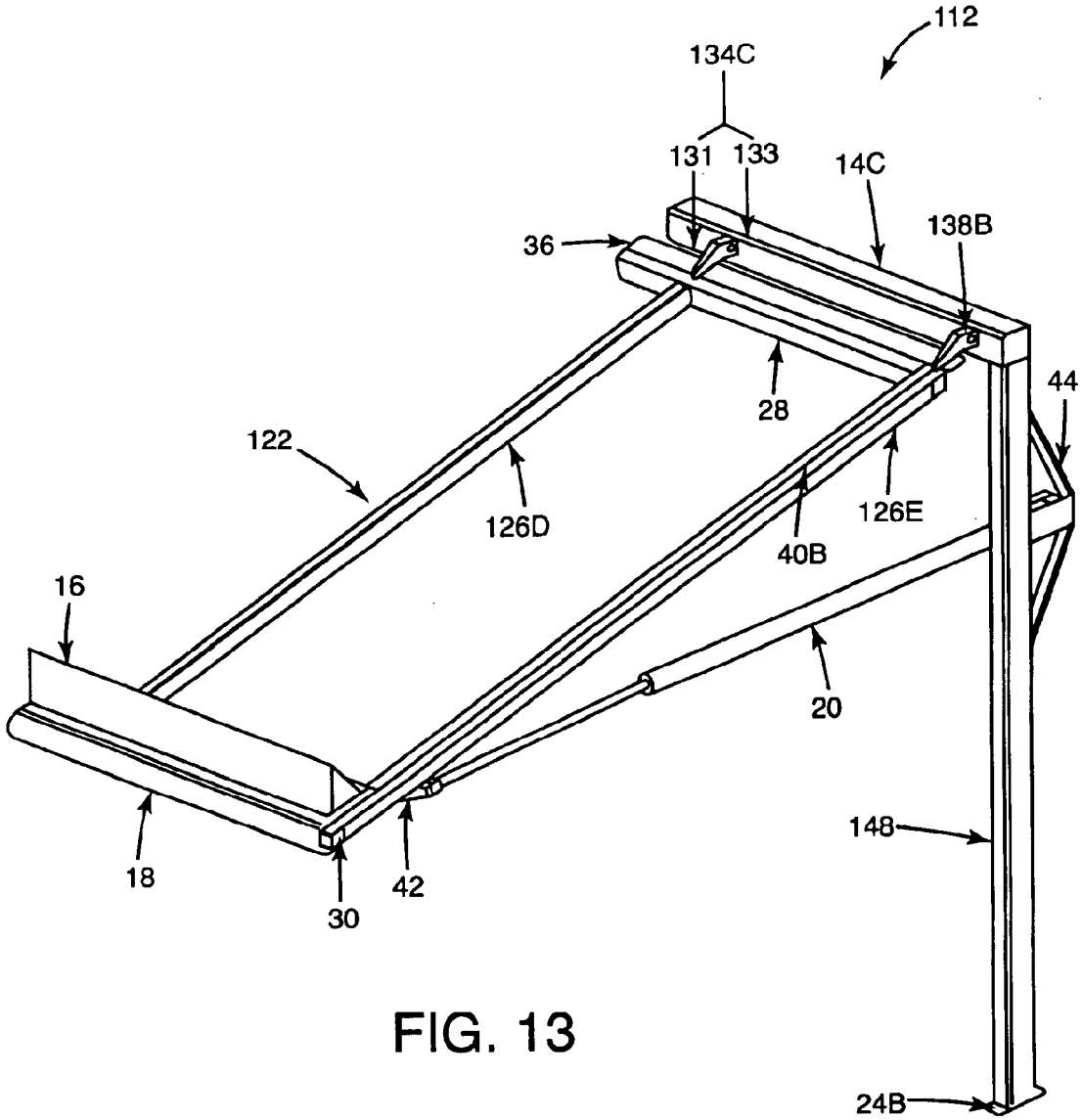
FIG. 13 is a front isometric view of a door assembly with the door in a partially open position.

FIG. 13 illustrates an alternative embodiment of the door member 122, the truss support system 16, the door member sealing means 18 and the hinges 134, 138 in accordance with one embodiment of the present invention, as follows:

Door Member

The door member 122 is constructed of steel tubing and includes four basic components. The load bearing vertical member 126E is located vertically at the outermost portion of the door 122. The pinpoint assembly 42 and the outer hinge 138B are fastened to the vertical member 126E. The center support vertical member 126D is located in a vertical position between the load bearing upright tubes 126A, B at a spacing not exceeding eight feet. The center hinge 134C is fastened to the vertical member 126D. The upper structural tube 28 is placed and secured horizontally across a top end of all the vertical members 126. The lower structural tube 30 is placed and secured horizontally across a bottom end of all the vertical members 126.

Truss Support System

The door member 122 is constructed with a load bearing arc such that the door member 122 does not lose its structural integrity whenever it is placed in an outwardly, horizontal, open position. Pressure is applied to the lower structural tube 30 creating an arc, then a "V-truss" 16 is disposed horizontally along the structural tube 30 and is fastened onto the lower outside face of the door member 122 with the point of the "V" facing directly outward, thus maintaining the load bearing arc.

Door Member Seal

The seal 18 is disposed horizontally along the bottom portion of the door member 122. The seal 18 is a rubber strap secured to the inside and the outside face of the lower structural tube 30. The seal 18 wraps underneath the door member 122 when the door member 122 is in a closed position, thus creating a weather tight seal capable of conforming to irregularities of the floor surface.

The top seal and side seals arc constructed of angled members 36, 40 and a compressed foam stripping 68. The vertical angled member 40B is secured vertically and flush to the outside face of the load bearing uprights 126A, B and is secured horizontally and flush to the outside face of the upper horizontally disposed structural tube 28. When the door member 122 is in a closed position the angled member 40B overlaps the inside corner of the outside face of the jamb 14B. Likewise, the angled member 36 overlaps the outside face of the horizontal header 14C. Compressed foam stripping 68 is disposed along the entire length of the inside portion of both the top horizontal angled member 36 and the side vertical angled members 40 that overlap the outside of the door frame 14.

The Hinges

Both the outer hinge 138 and the inner hinge 134 are constructed of an outer hinge component 133 and an inner hinge component 131, one difference being the thickness of the steel from which they are constructed. The outer hinge component 133 includes two steel plates, with a drilled hole in each, placed vertically and parallel to each other, spaced apart at a predetermined distance and secured to the horizontal header 14C of the frame 14. The set of outer hinge components 133 are secured above each load bearing vertical member 126A, E and above each center support vertical member 126B, C, D.

The inner hinge component 131 includes an elongated piece of steel with a hole drilled therethrough, matching the size and placement of the hole defined in the outer hinge component 133. The inner hinge components 131 are placed and secured to the top of the door member 122 in a manner such that they are mounted vertically and parallel to the outer hinge component 133 when the door member 122 is in a closed position. The door member 122 is fastened to the frame 14 when the holes in both the outer hinge components 133 and the inner hinge components 131 are aligned and a bolt is placed and secured through holes defined by both hinge components 131, 133.

Figure 14:
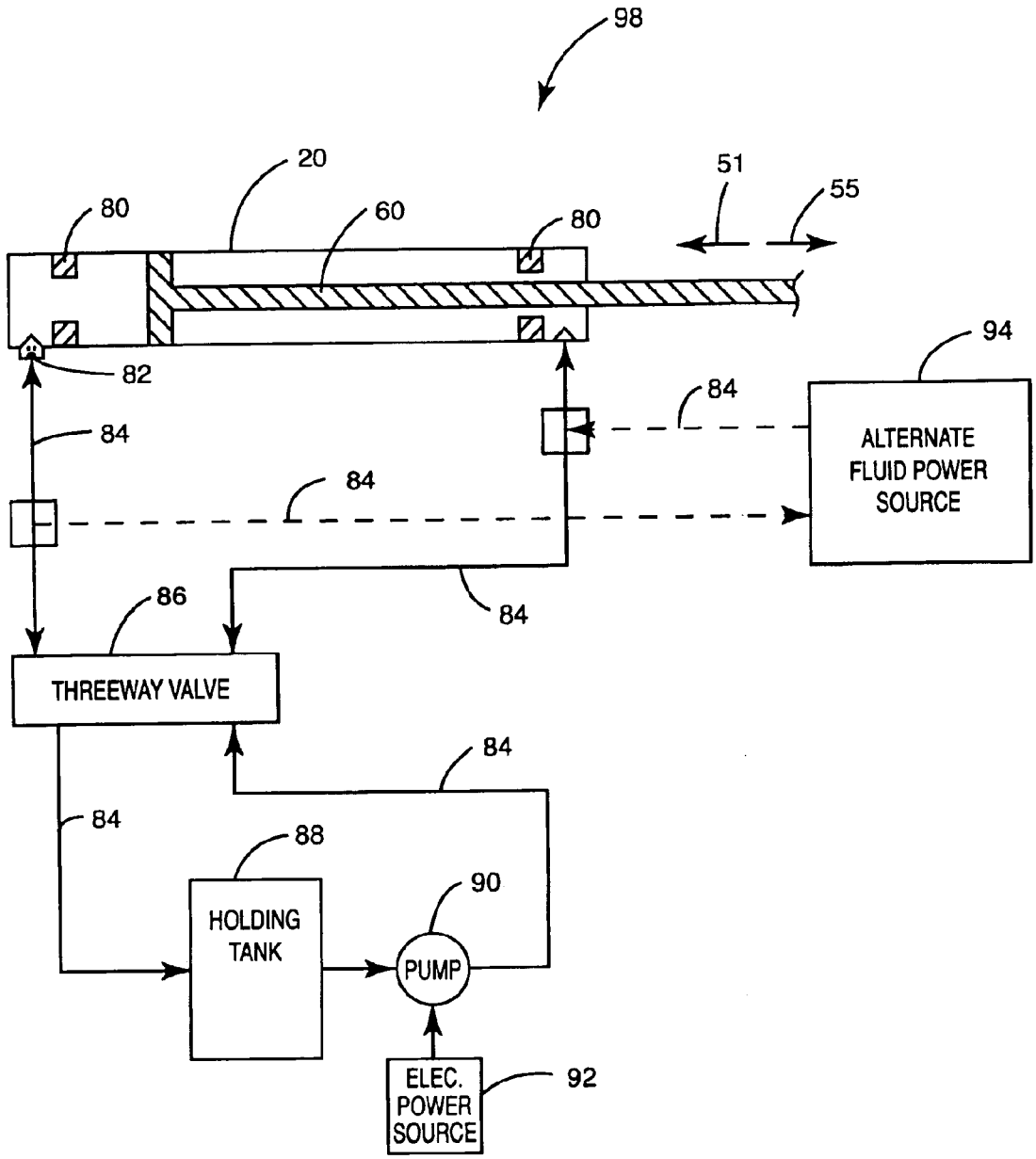
FIG. 14 is a block diagram of a hydraulic power system.

FIG. 14 is a block diagram of a hydraulic system 98 according to one embodiment of the present invention. The hydraulic system 98 comprises the hydraulic cylinder 20, a ram 60, mechanical safety stops 80, hydraulic hoses 84, a three way valve 86, a holding tank 88 and a pump 90. The hydraulic cylinder 20 includes the ram 60 (or piston) and mechanical safety stops 80 to mechanically restrict the travel of the ram 60. In case hydraulic power is lost whenever the ram 60 is supporting the load of the door member 22, a restriction orifice 82 releases the hydraulic fluid at a controlled rate such that the door member 22 is lowered easily to the ground. The three way valve 86 controls the direction for the door member 122 (e.g. open or close). The hydraulic fluid collects in the holding tank 88 which is fluidly coupled to the pump 90. The pump is electrically operated by electrical power source 92. In case the electrical power source 92 fails, is disrupted or is unavailable (e.g. remote locations) the hydraulic system provides couplers to connect an alternate fluid power source 94 (e.g. the hydraulic system of a tractor) to operate the door member 22.

In use, the three-way valve 86 directs fluid to the cylinder 20 and actuates the ram 60. If fluid is introduced at the rear of the cylinder 20 the ram 60 is driven in an outwardly direction 53 thus raising the door member 22 (122). Through operation of the three-way valve 86 fluid may be introduced at the forward end of the cylinder moving the ram 60 in an inwardly direction 51, thus lowering the door member 22 (122). The ram may be stopped at any intermediate position between the mechanical stops 80 to maintain the door member 22 (122) in a partially open position.

Two hydraulic cylinders 20 (only one is shown) are used, one on either side of the door member 22 (122) connecting the upper pinpoint assembly 44 to the lower pinpoint assembly 42, to operate the door member 22 (122) such that it moves from a vertically closed position to a horizontal open position by extending the ram 60 in an outwardly direction 53. The door member 22 is closed by inwardly 51 retracting the cylinder ram 60.

The foregoing description of the specific embodiments of the invention has been presented for the purposes of illustration and description. It is not intended to be exhaustive or to limit the invention to the precise form disclosed. Many modifications and variations are possible in light of the above teaching. It is intended that the scope of the invention be limited not with this description, but rather by the claims appended hereto.

Although the present invention has been described with reference to preferred embodiments, workers skilled in the art will recognize that changes may be made in form and detail without departing from the spirit and scope of the invention.

What is claimed is:

1. An overhead door assembly for a building having an opening to be closed by a door, the door assembly having a vertical closed position and a horizontal open position and the door assembly having dimensions that are substantially equal to the building opening, comprising:

a frame, comprising a horizontal support member and first and second vertical members fixedly mounted to either end of the horizontal member, the vertical members fixedly mounted to a ground portion;

a one-piece door member having a thickness including top and bottom horizontal ends and first and second vertical sides, the top horizontal end of the door member pivotally mountable to the horizontal member of the frame and the door member movable from the closed position to the open position about the pivot point;

a hydraulic cylinder comprising a first end and a second end, the first end pivotally mountable to a portion of either one of the first and second vertical members, and the second end pivotally mountable to the door member, the hydraulic cylinder having a ram movably disposed within the hydraulic cylinder communicating an opening force and a closing force to the door member, and a load bearing truss externally mounted to an outside face of the bottom horizontal end of the door member with respect to the building and providing sufficient support to the door member wherein structural integrity of the door is maintained when the door member is in the open position.

2. The overhead door assembly of claim 1 and further comprising a resilient weather-resistant seal disposed along the bottom horizontal end of the door member and fixedly mounted thereon, the weather-resistant seal sealing gaps between the bottom horizontal end of the door member and the ground portion.

3. The overhead door assembly of claim 1 and further comprising connecting means for connecting hydraulic hoses from an alternative hydraulic power source.

4. The overhead door assembly of claim 1, wherein a cycle time for opening or closing the door member is between 28 to 32 seconds.

5. The overhead door assembly of claim 1, wherein a cycle time for opening or closing the door member is not greater than about 32 seconds.

6. The overhead door assembly of claim 1, wherein the door member closes flush with a building surface.

7. The overhead door assembly of claim 1 and further comprising a resilient seal for sealing a perimeter of the door member and providing a weather tight seal around all four sides of the door member.

8. The overhead door assembly of claim 1 and further comprising a three position hydraulic valve for controlling the direction of the door member.

9. The overhead door assembly of claim 8 and further comprising check valve locks for locking the door member in a selected position.

10. The overhead door assembly of claim 1, wherein the hydraulic cylinder further comprises a mechanical stop disposed within the cylinder.

11. The overhead door assembly of claim 1, wherein the frame is anchored to a concrete footing.

12. The overhead door assembly of claim 11, wherein the frame is anchored to the concrete footing with anchor bolts fastened to the concrete footing.

13. The overhead door assembly of claim 1, wherein the frame structure supports a substantial portion of the load of the door member.

14. An overhead door for a building having an opening to be closed by the door, the door having a vertical closed position and a horizontal open position and the door having dimensions that are substantially equal to the building opening, comprising:

a one-piece door member having a thickness including top and bottom horizontal ends and first and second vertical sides;

means for fixedly mounting the top horizontal end of the door member to a support structure;

means for mounting to the door member a mechanism adapted and configured to open and close the door member; and an external load bearing truss fixedly attached to an outside face of the door member with respect to the building and providing sufficient support to the door member wherein structural integrity of the door is maintained when the door member is in the open position.

15. The overhead door of claim 14 and further comprising a sealing means for sealing the bottom horizontal end of the door member against a ground portion.

16. The overhead door of claim 15, wherein the sealing means comprises resilient weather-resistant seal disposed along the bottom horizontal end of the door member and fixedly mounted thereon, sealing gaps between the bottom horizontal end of the door member and the ground portion.

17. The overhead door of claim 14, wherein the mounting means, fixedly mounting the top horizontal end of the door member to the support structure comprises a plurality of pairs of hinges fastened with a plurality of bolts.

18. The overhead door of claim 14, and further comprising closing means, closing the door flush with the building opening.

19. The overhead door of claim 18, wherein the closing means, closing the door flush with the building opening comprises angled members that overlap the building opening.

20. The overhead door of claim 18, wherein the closing means further comprises a seal.

21. The overhead door of claim 20, wherein the seal comprises a compressed foam seal.

22. An overhead door having a vertical closed position and a horizontal open position provided in a building having an opening to be closed by the door, the overhead door having dimensions that are substantially equal to the building opening, comprising:

a one-piece door member having a thickness including top and bottom horizontal ends and first and second vertical sides;

means for fixedly mounting the top horizontal end of the door member to a support structure;

means for mounting to the door member a mechanism adapted and configured to open and close the door member; and an external load bearing truss fixedly mounted to an outside face of the door member with respect to the building and providing sufficient support to the door member wherein structural integrity of the door is maintained when the door member is in the open position.

23. The overhead door of claim 22 and further comprising sealing means, sealing the bottom horizontal end of the door member against a ground portion.

24. The overhead door of claim 23, wherein the sealing means comprises a resilient weather-resistant seal disposed along the bottom horizontal end of the door member and fixedly mounted thereon, sealing gaps between the bottom horizontal end of the door member and the ground portion.

25. The overhead door of claim 22, wherein the mounting means, fixedly mounting the top horizontal end of the door member to the support structure comprises a plurality of pairs of hinges fastened together with a plurality of bolts.

26. The overhead door of claim 22, wherein the mounting means, mounting the door member to the mechanism adapted and configured to open and close the door member comprises a hydraulic cylinder.

* * * * *